US005700424A

United States Patent [19]

Matsuo et al.

[11] Patent Number: 5,700,424

[45] Date of Patent: Dec. 23, 1997

[54] SYSTEM FOR PREPARING ALUMINUM ALLOY STRIP HAVING IMPROVED FORMABILITY AND BAKE HARDENABILITY

[75] Inventors: Mamoru Matsuo; Zhu Yan, both of Tokyo, Japan

[73] Assignee: Sky Aluminium Co., Ltd., Tokyo, Japan

[21] Appl. No.: 610,547

[22] Filed: Mar. 6, 1996

[51] Int. Cl.[6] ..... C21D 9/56

[52] U.S. Cl. ..... 266/108; 266/103; 266/111; 148/601

[58] Field of Search ..... 266/103, 108, 266/110, 111; 148/693, 601

[56] References Cited

U.S. PATENT DOCUMENTS

| | | | |
|---|---|---|---|
| 4,379,547 | 4/1983 | Shimbashi et al. | 266/103 |
| 4,743,196 | 5/1988 | Imose et al. | 266/103 |
| 4,913,748 | 4/1990 | Sellitto et al. | 266/103 |

FOREIGN PATENT DOCUMENTS

| | | | |
|---|---|---|---|
| 406240424 | 8/1994 | Japan | 148/693 |

*Primary Examiner*—Scott Kastler

*Attorney, Agent, or Firm*—Sughrue, Mion, Zinn, Macpeak & Seas, PLLC

[57] ABSTRACT

A system for heat treating a rolled strip of Al—Mg—Si alloy includes a primary heating zone for solution treating the strip at 480° C. or higher, a first cooling zone for cooling the strip at a rate of at least 100° C./min. to 100° C. or lower, a secondary heating zone for heating the strip to 120°–250° C. within 10 minutes for thereby adjusting a proof stress of 70–120 N/mm$^2$ directly or after holding for 10 minutes or less, a coiler for winding the strip into a coil at 140° C. or lower, and a unit for holding the coil at 50°–140° C. for at least 3 hours. The process from solution treatment to winding is continuous as well as from winding to stabilizing treatment. The strip has improved formability and bake hardenability and a minimized secular change at room temperature.

7 Claims, 6 Drawing Sheets

SYSTEM FOR PREPARING ALUMINUM ALLOY STRIP HAVING IMPROVED FORMABILITY AND BAKE HARDENABILITY

BACKGROUND OF THE INVENTION

1. Field of the Invention

This invention relates to preparing an aluminum alloy strip which is subject to forming and paint baking for use as sheet stock for automotive bodies and parts, machinery parts, and electric appliance parts. More particularly, it relates to a system for preparing an aluminum alloy strip having improved formability, high strength after paint baking, and a minimized secular change at room temperature.

2. Prior Art

In the past, cold rolled steel strips were widely used as automotive body sheets. From the standpoint of vehicle weight reduction, use of rolled aluminum alloy strips is now widespread. Since automotive body sheets are pressed or otherwise worked before use, they are required to be improved in formability and workability and leave no Luders marks during forming and working. They are required not only to have high strength, but also to exhibit high strength after paint baking because of the necessity of coating and baking of paint.

Among conventional aluminum alloys for use as automotive body sheets widely used are age hardenable alloys of JIS 6000 series, that is, Al—Mg—Si alloys. The age hardenable Al—Mg—Si alloys have the advantage that they have relatively low strength during forming and working so that they are readily formable and workable while they are age hardened by the heat during paint baking so that they exhibit high strength after paint baking. They are also free of Luders marks.

One common prior art process for preparing Al—Mg—Si alloys such that they may be age hardenable upon paint baking involves soaking of a cast ingot, hot rolling and cold rolling into a strip of a certain gage, optional intermediate annealing between the hot rolling and the cold rolling or midway the cold rolling, and solution treatment for quenching. This prior art conventional preparation process, however, is difficult to fully meet the current requirements on automotive body sheets.

More particularly, the advanced technology demand is to reduce the gage of alloy strips in order to achieve a further cost reduction. This requires further enhancement of strength such that strength is still acceptable even at a reduced gage. In this respect, Al—Mg—Si alloy strips obtained by prior art conventional processes are unsatisfactory.

From the standpoints of energy saving and efficient production and partially because resins and other paint components which should avoid exposure to elevated temperatures are used, the recent trend in the art of paint baking is to use a lower temperature and a shorter time for baking than before. Under such milder baking conditions, Al—Mg—Si alloy strips obtained by prior art conventional processes become short of hardening upon paint baking (i.e., bake hardening), failing to attain sufficiently high strength after paint baking.

Attempts were made to solve the above-mentioned problems of Al—Mg—Si alloys by modifying the strip manufacturing process. The inventors already proposed an improved process in Japanese Patent Application Kokai (JP-A) No. 272000/1994. In this process, a strip is held at a temperature in the range of 150° to 300° C. for 0 to 600 seconds midway or after the cooling step for quenching following solution treatment and within 72 hours from the holding, subjected to heat treatment at a temperature in the range of 50° to 140° C. for ½ to 50 hours. The process of JP-A 272000/1994 was successful in increasing the strength of stock material as well as the strength after paint baking, as compared with the prior art conventional processes of manufacturing Al—Mg—Si alloy strips. The improvements by our previous process are still unsatisfactory for the recent severer demand on automotive body sheets.

In general, enhancement of age hardenability for gaining a substantial strength increase upon paint baking creates the following problem. If the strip is allowed to stand for a long time after its preparation, natural aging (or aging at room temperature) takes place during the storage period so that the strip experiences a change with time, that is, hardening. When the strip is subject to forming, working and paint baking after the storage, its forming and working capabilities have deteriorated. The previous process has not incorporated a countermeasure to this problem.

For automotive body sheets, it is crucial that the three requirements of stock material strength, high strength after paint baking, and minimized change of formability with time be simultaneously met. In the previous process, optimum conditions permitting the three requirements to be simultaneously met were not definitely recognized. Carrying out the previous process does not necessarily satisfy the three requirements at the same time.

The previous process has not taken into account the mass and efficient productivity requisite for the manufacture on an actual industrial scale. In particular, the construction of a practical system for mass scale manufacture has not been clarified.

SUMMARY OF THE INVENTION

Therefore, an object of the present invention is to provide a system for preparing an aluminum alloy strip capable of satisfying the above-mentioned three requirements as automotive body sheets in that the strip has improved formability and workability, improved bake hardenability, and potential increase of strength upon paint baking, and experiences a minimal change with time at room temperature after preparation and hence, a minimized loss of formability caused by hardening due to natural aging during long-term storage. Another object of the present invention is to provide a system for preparing an aluminum alloy strip having such improved properties on an industrially acceptable mass scale.

The inventors have found that the above objects can be attained by selecting a proper composition of an Al—Mg—Si alloy, optimizing conditions of solution treatment and subsequent heat treatments of a strip manufacturing process, and developing an appropriate system for the process.

The present invention provides a system for processing a rolled strip of an aluminum alloy consisting essentially of 0.3 to 1.5% by weight of Mg, 0.5 to 2.5% by weight of Si, and the balance of aluminum. The alloy may optionally contain at least one element selected from the group consisting of 0.03 to 1.2% of Cu, 0.03 to 1.5% of Zn, 0.03 to 0.4% of Mn, 0.03 to 0.4% of Cr, 0.03 to 0.4% of Zr, 0.03 to 0.4% of V, 0.03 to 0.5% of Fe, and 0.005 to 0.2% of Ti, as expressed in % by weight. The system includes means for continuously unraveling a rolled strip from its coil; a continuous heat treatment section for continuously receiving the rolled strip from the unraveling means, heat treating it, and delivering it outward; means for continuously winding up the rolled strip exiting from the continuous heat treatment section into a coil form; and means for holding the coil of rolled strip at a temperature in the range of 50 to 140° C. for at least 3 hours. The continuous heat treatment section including a first accumulator for continuously receiving the strip from the unraveling means and feeding it downstream; a primary heating zone disposed downstream of the first accumulator for continuously receiving the strip therefrom and heating it to a temperature of at least 480° C.; a first cooling zone disposed downstream of the primary heating zone for continuously receiving the strip therefrom and cooling it at a rate of at least 100° C./min. to a temperature of not greater than 100° C.; and a secondary heating zone disposed downstream of the first cooling zone for continuously receiving the strip therefrom and heating it to a temperature in the range of 120° to 250 C. within 10 minutes from the end of cooling. The aluminum alloy strip exiting from the holding means has improved formability and bake hardenability and a minimized change with time at room temperature.

In one preferred embodiment, the continuous heat treatment section further includes a second cooling zone disposed downstream of the secondary heating zone for continuously receiving the strip therefrom and cooling it to a temperature of not greater than 140° C.; and a second accumulator disposed downstream of the second cooling zone for continuously receiving the strip therefrom and feeding it to the winding means.

In another preferred embodiment, the continuous heat treatment section further includes a second accumulator disposed between the first cooling zone and the secondary heating zone for continuously transferring the strip therebetween such that the strip may travel through the second accumulator for a residence time within 10 minutes.

In a further preferred embodiment, the holding means includes a holding furnace for holding the coil of rolled strip being wound up in the winding means at a temperature in the range of 50° to 140°C.

Also preferably, the holding means includes means for continuously or intermittently conveying the coil of rolled strip forward while heating it at a temperature in the range of 50° to 140° C. such that the residence time within the temperature range is at least 3 hours.

BRIEF DESCRIPTION OF THE DRAWINGS

These and further features of the present invention will be apparent with reference to the following description and drawings, wherein.

DETAILED DESCRIPTION OF THE INVENTION

Figure 1:
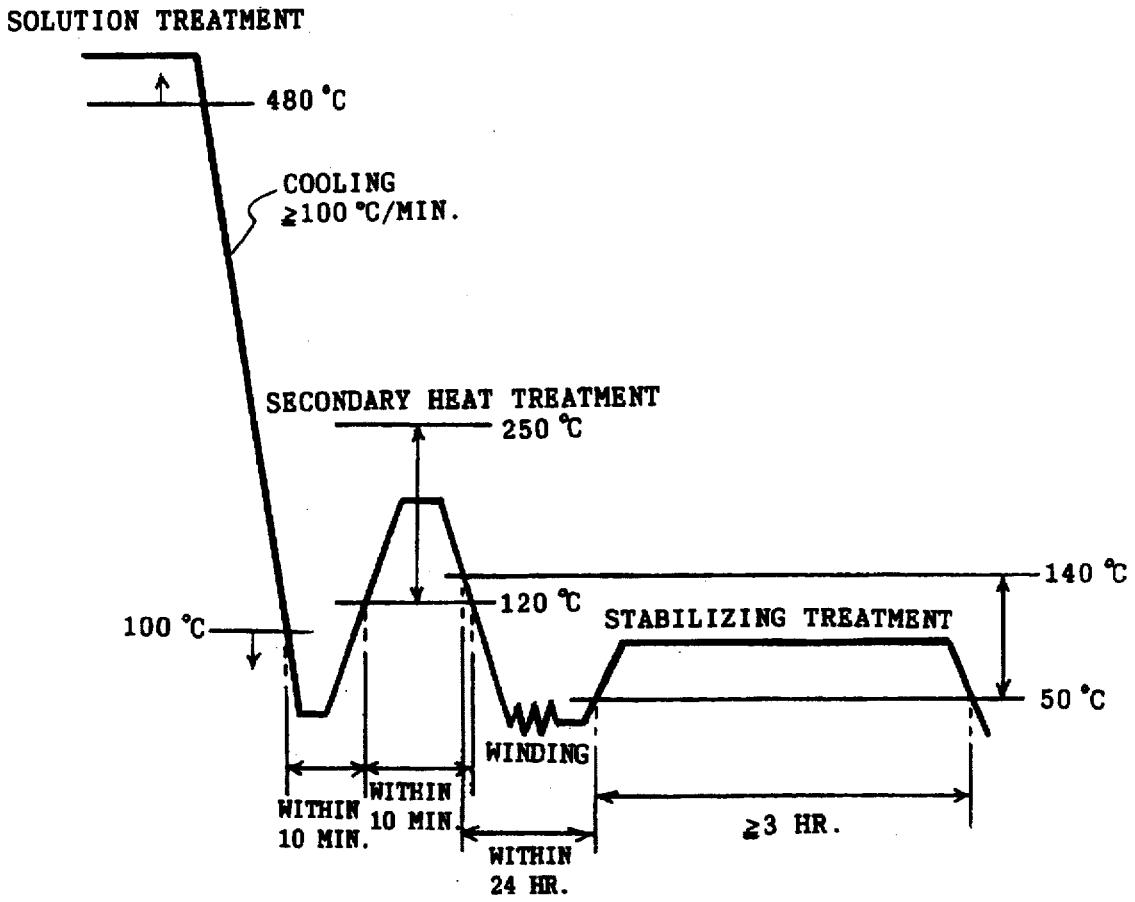
FIG. 1 is a diagram explaining a process subsequent to solution treatment in the manufacture of an aluminum alloy strip according to the invention.

First described is the composition of an aluminum alloy for which the system of the invention is intended.

The aluminum alloy consists essentially of 0.3 to 1.5% of Mg, 0.5 to 2.5% of Si, and the balance of aluminum. The alloy optionally contains at least one element selected from the group consisting of 0.03 to 1.2% of Cu, 0.03 to 1.5% of Zn, 0.03 to 0.4% of Mn, 0.03 to 0.4% of Cr, 0.03 to 0.4% of Zr, 0.03 to 0.4% of V, 0.03 to 0.5% of Fe, and 0.005 to 0.2% of Ti. Containment of incidental impurities is acceptable. With respect to the alloy composition, all percents are % by weight based on the total weight of alloy. The type and content of alloy components are limited for the following reason.

Mg:

Magnesium is a fundamental alloy component in the alloy system to which the invention pertains. Mg combined with Si contributes to strength improvement. Less than 0.3% of Mg will form a less amount of $Mg_2Si$ which contributes to strength improvement through precipitation hardening during paint baking, failing to establish sufficient strength after paint baking. More than 1.5% of Mg will detract from formability. The Mg content is thus limited to the range of 0.3 to 1.5%.

Si:

Silicon is also a fundamental alloy component in the alloy system to which the invention pertains. Si combined with Mg contributes to strength improvement. Silicon also contributes to refinement of crystal grains because metallic silicon grains that have precipitated upon casting of aluminum alloy are deformed at their periphery by processing, offering sites where recrystallization nuclei form upon solution treatment. Less than 0.5% of Si is not effective for these purposes. More than 2.5% of Si will leave larger Si grains, detracting from the toughness of alloy. The Si content is thus limited to the range of 0.5 to 2.5%.

Cu, Zn, Mn, Cr, Zr, V, Ti, Fe:

These elements are not essential although one or more of them are preferably added for the purposes of strength improvement and grain refinement. Specifically, copper is effective for improvement of strength. Less than 0.03% of Cu would be ineffective for its purposes whereas more than 1.2% of Cu would detract from corrosion resistance. The Cu content is thus limited to the range of 0.03 to 1.2%.

Zinc contributes to strength improvement by improving the age hardenability of alloy. Less than 0.03% of Zn would be ineffective for its purposes whereas more than 1.5% of Zn would detract from formability and corrosion resistance. The Zn content is thus limited to the range of 0.03 to 1.5%.

Manganese, chromium, zirconium, and vanadium are effective for strength improvement, grain refinement, and structure stabilization. For each of them, contents of less than 0.03% would be ineffective whereas beyond 0.4%, the additive effects would be saturated and giant intermetallic compounds can be formed to adversely affect formability. The content of Mn, Cr, Zr, and V is thus limited to the range of 0.03 to 0.4%.

Titanium is also effective for improvement of strength improvement and refinement of cast structure. Less than 0.005% of Ti would be ineffective whereas beyond 0.2%, the additive effects would be saturated and giant precipitates can be formed. The Ti content is thus limited to the range of 0.005 to 0.2%.

Iron is also effective for improvement of strength improvement and grain refinement. Less than 0.03% of Fe would be ineffective whereas more than 0.5% of Fe would detract from formability. The Fe content is thus limited to the range of 0.03 to 0.5%. It is noted that less than 0.03% of Fe is inevitably contained in the alloy when standard aluminum ground metal is used.

It is understood that the above-mentioned contents of Cu, Zn, Mn, Cr, Zr, V, Ti, and Fe should be met when they are contained as positive additive elements. It is acceptable that the alloy contains any of these elements in a smaller amount than the lower limit.

The remainder of the alloy composition is aluminum. It is acceptable that the alloy contains incidental impurities. It is noted that a minor amount of beryllium is often added to magnesium-containing aluminum alloys for the purpose of preventing oxidation of molten alloy. For the aluminum alloy of the invention, addition of 0.0001 to 0.01% of Be is acceptable. Also, boron is sometimes added along with titanium for the purpose of grain refinement. For the aluminum alloy of the invention, it is acceptable to add 500 ppm or less of B together with Ti.

Next, the process of preparing an aluminum alloy strip using the system of the invention is described.

The process prior to solution treatment, that is, the process until a rolled strip of a predetermined gage is obtained is identical or similar to the conventional process relating to Al—Mg—Si alloys of JIS 6000 series. More particularly, an aluminum ingot is formed by a DC casting technique, soaked in a conventional manner, and then hot rolled and cold rolled until a strip of a predetermined gage is obtained. If desired, intermediate annealing may be done between the hot rolling and the cold rolling or midway the cold rolling step.

The cold rolling step is followed by solution heat treatment and subsequent heat treatment. The profile of these heat treatments is diagrammatically shown in FIG. 1.

The solution heat treatment is a step necessary to form a solid solution of $Mg_2Si$ in the matrix for imparting bake hardenability to improve strength after paint baking. It is also a step for effecting recrystallization to impart improved formability. Solution treatment at a temperature below 480° C. will form a lesser amount of solid solution of $Mg_2Si$, failing to provide bake hardenability. Although no upper limit is specified, the solution treatment temperature is desirably up to 580° C. in order to avoid eutectic melting and enlargement of recrystallized grains. No specific limit is imposed on the solution treatment time although it is 10 minutes at maximum in view of continuous treatment.

The solution treatment is followed by cooling or quenching at a cooling rate of at least 100° C./min. to a temperature of 100° C. or lower. A cooling rate of less than 100° C./min. allows an excessive amount of $Mg_2Si$ to precipitate during cooling, detracting from not only formability, but bake hardenability so that strength improvement after paint baking is not expectable. The ultimate cooling temperature or temperature at the end of quenching is 100° C. or lower, which is one of the important features of the invention. If the ultimate cooling temperature is above 100° C., formability is somewhat lost. Desired good formability is expectable only when the ultimate cooling temperature is 100° C. or lower. It is preferred that the ultimate cooling temperature be as low in the range below 100° C. as possible.

After the rolled strip is solution treated at a temperature of 480° C. or higher and then cooled to a temperature of 100° C. or lower at a cooling rate of at least 100° C./min. as mentioned above, it is heat treated again within 10 minutes. This heat treatment, referred to as secondary heat treatment, hereinafter, is by heating the strip to a temperature in the range of 120° to 250° C. and optionally holding at the temperature for a time of up to 10 minutes. The secondary heat treatment is adequately effected such that the strip as heat treated may have a proof stress or yield strength of 70 to 120 N/mm$^2$, especially 70 to 100 N/mm$^2$.

There exist crucial parameters on transition from the cooling step after the solution treatment to the secondary heat treatment. The temperature and time from the end of cooling to the start of secondary heat treatment should be 100° C. or lower and within 10 minutes, respectively. More particularly, clusters which precipitate at low temperatures generally have different nature from Guinier-Preston (GP) zones which precipitate during paint baking, typically at a temperature of 150° to 200° C. Once low temperature clusters precipitate, they last long enough, becoming an obstruction against strength improvement after paint baking. If the strip is kept over 10 minutes in the temperature range of not greater than 100° C. after the solution treatment and cooling, low temperature clusters as mentioned above form in the strip so that the strength improvement after paint baking is no longer expectable. Therefore, the lapse of time when the strip remains at a temperature of 100° C. or lower from the end of cooling to 100° C. or lower to the start of secondary heat treatment should be 10 minutes or less.

During secondary heat treatment, a heating temperature range of 120° to 250° C. is critical. Heating and holding at such high temperatures leads to formation of high temperature GP zones or high temperature clusters. Since the high temperature GP zones or clusters have the same structure as the GP zones to be formed during paint baking, they will grow during subsequent paint baking, achieving a rapid strength increase.

The duration of the secondary heat treatment may be basically determined in accordance with the temperature such that the strip as heat treated may have a proof stress of 70 to 120 N/mm$^2$. For the convenience of continuous treatment, an excessively long holding time is undesirable. When productivity and the length of a heating furnace are taken into account, the holding time is 600 seconds at maximum, especially within 300 seconds. Holding can be omitted insofar as a proof stress of 70 to 120 N/mm$^2$ is available.

As mentioned above, the secondary heat treatment is adequately effected such that the strip as heat treated may have a proof stress of 70 to 120 N/mm$^2$. The proof stress is given herein as an index showing the degree of formation of high temperature clusters or GP zones during the secondary heat treatment. Since high temperature clusters or GP zones formed during the secondary heat treatment will grow alone during subsequent stabilizing treatment at relatively low temperature, it suffices that high temperature clusters or GP zones are formed to some extent during the secondary heat treatment. The degree of formation of the clusters can be expressed in terms of a proof stress. A proof stress of less than 70 N/mm$^2$ means that high temperature clusters or GP zones are formed in amounts small enough to precipitate as low temperature clusters until the subsequent stabilizing treatment, which would become an obstruction against strength increase upon paint baking as previously mentioned. If high temperature clusters or GP zones are formed in such large amounts that a proof stress of more than 120 N/mm$^2$ is reached, there arises a problem that when the strip is heated over 3 hours in subsequent stabilizing treatment (or holding treatment), excessive age hardening at high temperature would proceed during later paint baking, resulting in the finished strip having a too high proof stress and poor workability. Therefore, among the temperature range of 120° to 250° C. and the holding time range within 600 seconds for the secondary heat treatment, a proper temperature and time should be selected such that the strip as heat treated may have a proof stress of 70 to 120 N/mm$^2$, especially 70 to 100 N/mm$^2$.

It is noted that high temperature clusters or GP zones are essentially formed at 100° C. or higher. In order to form high temperature clusters or GP zones such that a proof stress of 70 N/mm$^2$ or more may be reached, heating is necessary for a long time of more than 10 minutes if the heating temperature is less than 120° C., but above 100° C. The continuous heat treatment is substantially interrupted by such long-term heating. For this reason, the lower temperature range from 100° C. to less than 120° C. is omitted for the secondary heat treatment according to the process of the invention. Higher temperatures, on the other hand, make it easy to establish a proof stress of at least 70 N/mm$^2$. For example, at temperatures of 200° C. or higher, the goal can be accomplished without substantial holding, though the situation varies with a particular composition of alloy. At temperatures above 250° C., however, outstanding intergranular precipitation of precipitates occurs at the sacrifice of elongation. For these reasons, the temperature for the secondary heat treatment is limited to the range of 120° to 250° C.

The secondary heat treatment is followed by winding of the strip into a coil at a temperature of up to 140° C. and within 24 hours from the coil winding, by a stabilizing treatment of holding at a temperature of 50° to 140° C. for at least 3 hours. This stabilizing treatment may also be referred to as holding treatment or tertiary heat treatment. The stabilizing treatment is necessary for finally improving the stability of clusters, controlling a secular change after strip preparation, ensuring excellent formability, and achieving sufficient bake hardenability.

If the strip exiting from the secondary heat treatment is wound into a coil at a temperature of up to 140° C. and then allowed to stand under a further declining temperature condition, low temperature clusters would form due to aging, inhibiting the growth of GP zones during paint baking. In the process of the invention wherein the secondary heat treatment at 120° to 250° C. is incorporated, the progress of aging or change with time is very slow. The growth of low temperature clusters is controlled for a period of 24 hours. Even so, if the storage duration exceeds 24 hours, then low temperature clusters will grow to cancel the possibility of strength improvement upon paint baking. Therefore, the stabilizing treatment at 50° to 140° C. should preferably be carried out within 24 hours from the start of winding of the strip into a coil at 140° C. or lower. It is, of course, recommended to wind the strip into a coil immediately after the secondary heat treatment and carry out the stabilizing treatment immediately thereafter (that is, without cooling to a temperature below 50° C. during winding and thereafter). Differently stated, the time lag between the secondary heat treatment and the winding step and between the winding step and the stabilizing treatment is zero. This continuous process can be practiced using the means for continuously transporting the coil of rolled strip forward while heating and holding it at a temperature in the range of 50° to 140° C. It is understood that from the standpoint of material characteristics, the coiled strip may be allowed to stand for a duration within 24 hours until the stabilizing or holding treatment as previously mentioned. This means that there is a time margin between the secondary heat treatment/winding and the stabilizing or holding treatment, allowing for the step of placing the coil in a separate batch furnace where it is heated and held at 50° to 140° C.

If the strip temperature is above 140° C. immediately after the secondary heat treatment, the strip must be cooled to 140° C. or lower before winding into a coil. If the strip temperature is up to 140° C. (typically above 120° C.) immediately after the secondary heat treatment, the strip may be wound into a coil without positive cooling. If the strip as wound into a coil remains at a relatively high temperature approximate to 140° C., the coil may be held at a temperature in the range of 50° to 140° C. for at least 3 hours by utilizing the coil's own heat. Then the stabilizing treatment can be done without resorting to extra heating. In common practice, however, the stabilizing treatment at a temperature in the range of 50° to 140° C. is carried out by positive or external heating.

If the winding step after the secondary heat treatment is at a temperature higher than 140° C., the strip would be excessively increased in strength to detract from formability. Thus the winding temperature after the secondary heat treatment should preferably be not higher than 140° C.

It is critical that the stabilizing treatment be carried out at a temperature in the range of 50° to 140° C. for a holding time of at least 3 hours. Insofar as the secondary heat treatment at 120° to 250° C. is carried out to create high temperature clusters or GP zones such that the strip as heat treated may have a proof stress of 70 to 120 N/mm$^2$, advantageously aging takes place in the subsequent stabilizing treatment in such a manner that the high temperature clusters preformed during the secondary heat treatment may grow and hence, low temperature clusters are least likely to form, even if the stabilizing treatment is carried out at a relatively low temperature, for example, a temperature low enough for low temperature clusters to essentially form. If the temperature of stabilizing treatment is below 50° C., precipitation of low temperature clusters will occur to restrain strength improvement upon paint baking. If the temperature of stabilizing treatment is above 140° C., excessive aging will take place during stabilizing treatment over 3 hours, resulting in too increased strength, reduced elongation and poor formability. For this reason, the temperature of stabilizing treatment should be in the range of 50° to 140° C.

The holding time of stabilizing treatment should be at least 3 hours, especially at least 6 hours for the following reason. Since the aluminum alloy to which the invention pertains is of the age hardening type, it normally undergoes a change with time, namely a gradual increase of strength and a gradual decrease of elongation due to aging when it is allowed to stand at room temperature. The aging phenomenon eventually alleviates formability. The key feature of the invention is to restrain a change with time at room temperature. Since a change with time at room temperature takes place due to excessive voids introduced upon quenching, extinction of excessive voids will be effective for restraining a change with time at room temperature. It has been found that long-term holding at a relatively low temperature is effective to this end. More specifically, it has been found that a holding time of at least 3 hours, especially at least 6 hours is necessary for stabilizing treatment at a temperature in the range of 50° to 140° C. With a holding time of less than 3 hours, the majority of excessive voids are left to induce a change with time at room temperature. The maximum of the holding time may be suitably determined such that the strip as treated may not have a too high strength or too low elongation although the time depends on the strength (proof stress) after the secondary heat treatment and the temperature of the stabilizing treatment. From an economical standpoint, the holding time is generally within 50 hours.

As long as the proof stress of the strip immediately after the secondary heat treatment is controlled to a relatively low level of 70 to 100 N/mm$^2$, no problems arise even when the temperature of stabilizing treatment is relatively high within the range of 50° to 140° C. and even when the strip is held at such a temperature for a time of at least 3 hours. If the proof stress of the strip immediately after the secondary heat treatment is approximate to 120 N/mm$^2$, for example, 100 to 120 N/mm$^2$, then stabilizing treatment at a relatively high temperature within the range of 50° to 140° C. for a holding time of at least 3 hours will result in a strip tending to exhibit higher strength. If the proof stress of the strip immediately after the secondary heat treatment exceeds 120 N/mm$^2$, then stabilizing treatment at any temperature within the range of 50° to 140° C. for a holding time of at least 3 hours will result in a strip having a too high temperature, which indicates less elongation and poor formability. Therefore, the proof stress of the strip immediately after the secondary heat treatment should be controlled to the range of 70 to 120 N/mm$^2$, especially 70 to 100 N/mm$^2$.

Figure 2:
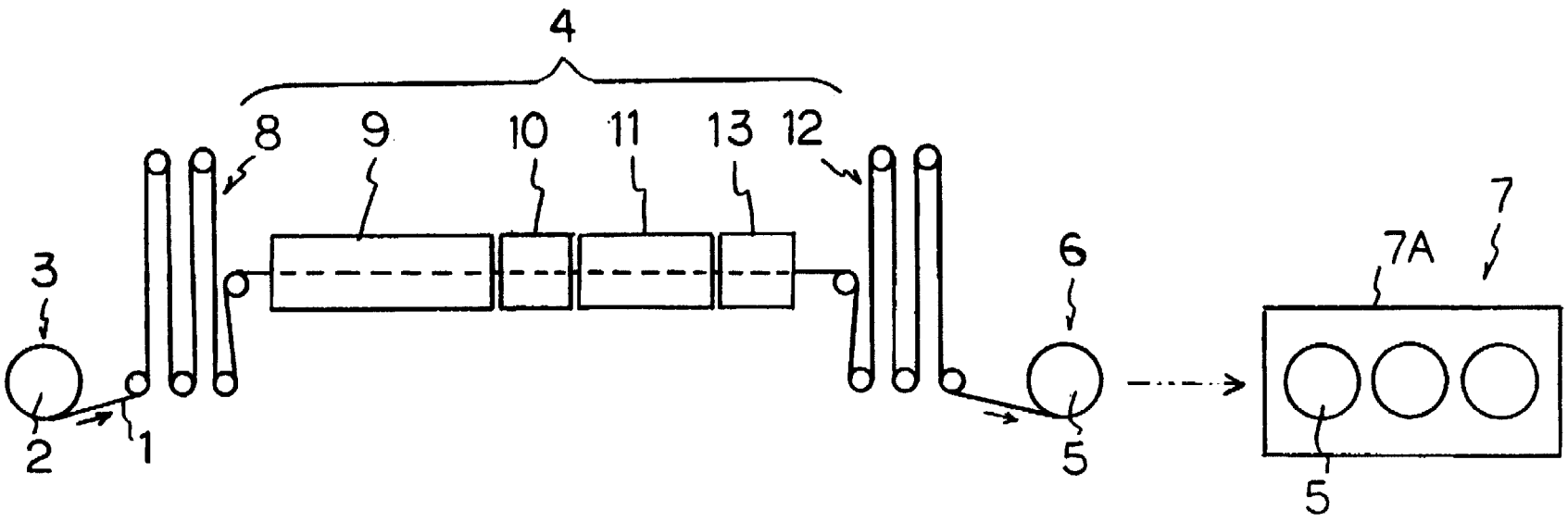
FIG. 2 is a schematic view illustrating a heat treating system according to a first embodiment of the invention.

Referring to FIGS. 2 to 6, there are illustrated several embodiments of the aluminum alloy strip preparing system according to the invention. FIG. 2 illustrates the most basic arrangement of the system of the invention and FIGS. 3 to 6 illustrate modified versions of the basic arrangement.

As shown in FIGS. 2 to 6, the system of the invention generally includes means 3 for continuously unraveling or unwinding a rolled strip 1 of the above-specified aluminum alloy composition from its coil 2, a continuous heat treatment section 4 disposed downstream of the unraveling means 3 for continuously receiving the rolled strip 1 therefrom, continuously heat treating it, and continuously delivering it outward, winding means 6 disposed downstream of the heat treatment section 4 for continuously taking up the rolled strip 1 exiting from the heat treatment section 4 into a coil 5, and holding means 7 disposed downstream of the winding means 6 for subjecting the coil 5 to stabilizing treatment as mentioned above. The continuous heat treatment section 4 is designed so as to continuously carry out a series of heat treatments from the solution treatment to the secondary heat treatment and optionally to the subsequent cooling.

Figure 3:
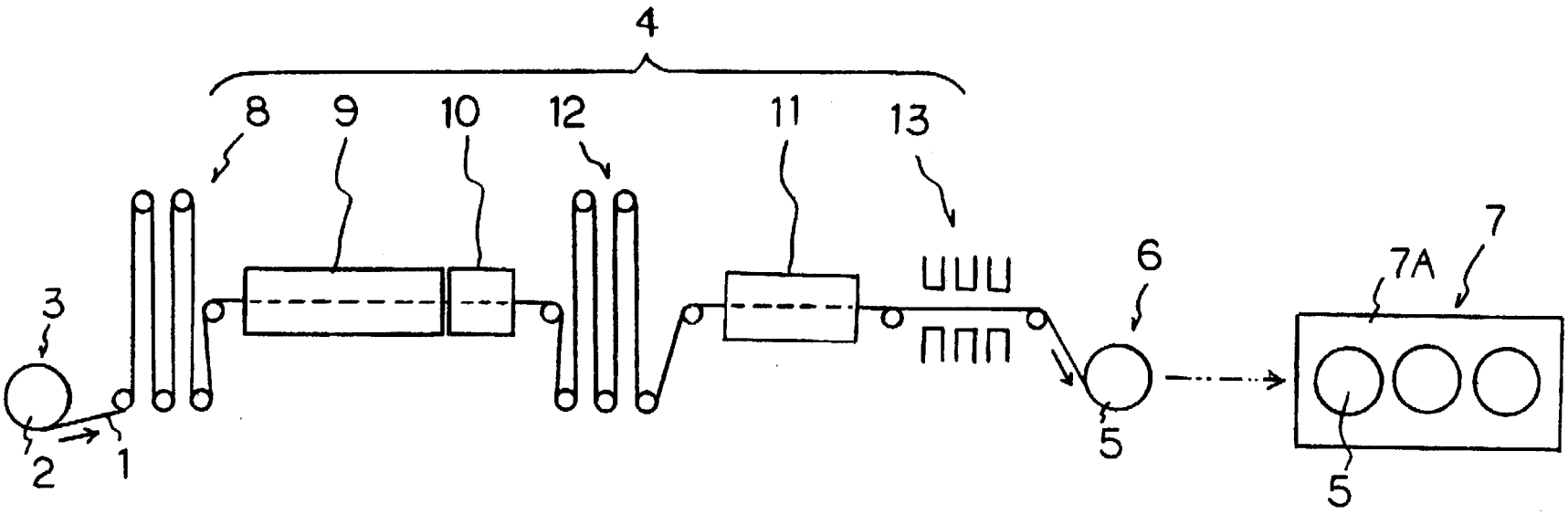
FIGS. 3, 4, 5 and 6 are schematic views illustrating a heat treating system according to different embodiments of the invention.
Figure 4:
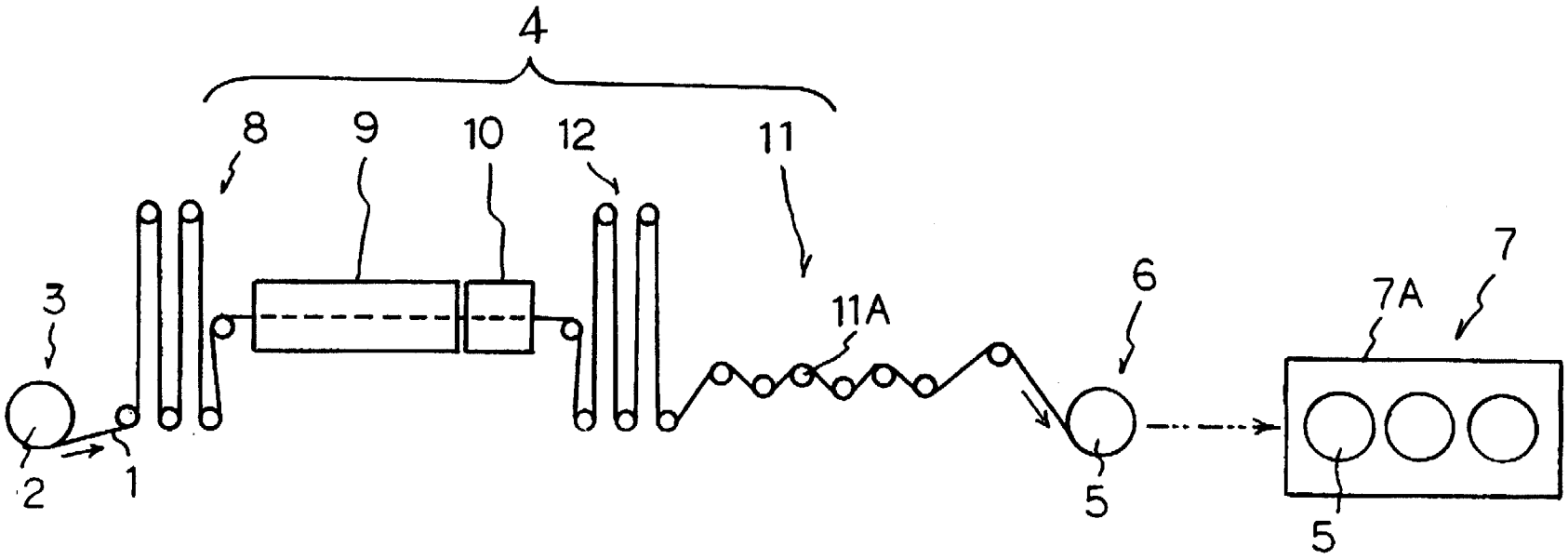

The arrangement of the continuous heat treatment section 4 is described in conjunction with FIGS. 2 to 4. Disposed at the foremost stage or inlet of the continuous heat treatment section 4 is a first accumulator 8 for continuously receiving the rolled strip 1 from the unraveling means 3 and continuously feeding it forward. The first accumulator 8 is designed to accumulate an appropriate length of the rolled strip 1 and adjust the accumulated length and if necessary, to regulate the tension of the rolled strip. The first accumulator may have a conventional structure. For example, it is diagrammatically shown as comprising a plurality of rolls around which the strip is serially trained.

Disposed downstream of the first accumulator 8 is a primary heating zone 9 for continuously receiving the rolled strip 1 from the first accumulator 8 and continuously heating it to a temperature of at least 480° C. The primary heating zone 9 is to carry out the aforementioned primary heat treatment or solution treatment. While the rolled strip continuously travels through the zone 9, the strip is continuously heated to an ultimate temperature of at least 480° C. by electromagnetic heating, forced hot air heating, and radiation heating alone or in arbitrary combination.

Disposed downstream of the primary heating zone 9 is a first cooling zone 10 for continuously receiving the rolled strip 1 from the primary heating zone 9 (where it has been heated to an ultimate temperature of at least 480° C.) and continuously cooling it to a temperature of 100° C. or lower at a rate of at least 100°C./min. While the rolled strip continuously travels through the zone 10, the strip is continuously cooled by forced air cooling, mist water cooling, water cooling, and warm water cooling alone or in arbitrary combination. For cooling other than forced air cooling, the zone 10 is equipped with a water drain and a dryer.

Disposed downstream of the first cooling zone 10 is a secondary heating zone 11 for continuously receiving the rolled strip 1 from the first cooling zone 10 (where it has been cooled to 100° C. or lower) and continuously heating it again to a temperature in the range of 120° to 250° C. The secondary heating zone 11 is to carry out the aforementioned secondary heat treatment. While the rolled strip continuously travels through the zone 11, the strip which has been cooled to 100° C. or lower in the first cooling zone 10 is heated again to a temperature in the range of 120° to 250° C. within 10 minutes. In the embodiment of FIG. 2, the secondary heating zone 11 is directly connected to the outlet of the first cooling zone 10. In the embodiments of FIGS. 3 and 4, the secondary heating zone 11 is connected to the outlet of the first cooling zone 10 through an intervening second accumulator 12. The second accumulator 12 is similar to the first accumulator 8. Like the primary heating zone 9, the secondary heating zone 11 is designed such that during passage through the zone 11, the strip is heated by electromagnetic heating, forced hot air heating, and radiation heating alone or in arbitrary combination. Alternatively, the secondary heating zone 11 includes a series of heating rolls 11A for directly heating the strip as shown in FIG. 4.

In the embodiments of FIGS. 2 and 3, a second cooling zone 13 is disposed downstream of the secondary heating zone 11. In the embodiment of FIG. 2 wherein no accumulator intervenes between the first cooling zone 10 and the secondary heating zone 11, a second accumulator 12 is disposed at the last stage or outlet of the continuous heat treatment section 4. The second cooling zone 13 is to continuously cool the rolled strip 1 to a temperature of 140° C. or lower before it is wound into a coil by the winding means 6, that is, such that the winding temperature is 140° C. or lower. The second cooling zone 13 may be omitted where the heating temperature in the secondary heating zone is relatively low or where the strip spontaneously undergoes a substantial drop of temperature while it is transferred from the secondary heating zone 11 to the winding means 6 directly (FIG. 3) or through the second accumulator 12 (FIG. 2). It is understood that the structure of the second cooling zone 13 may be the same as the first cooling zone 10.

The winding means 6 is disposed at the exit of the continuous heat treatment section 4, more particularly at the outlet of the second accumulator 12 in the embodiment of FIG. 2, at the outlet of the'second cooling zone 13 in the embodiment of FIG. 3, or at the outlet of the secondary heating zone 11 in the embodiment of FIG. 4. The holding means 7 is disposed downstream of the winding means 6. The winding means 6 and holding means 7 should be designed and arranged such that the rolled strip which has been heated at a temperature of 120° to 250° C. in the secondary heating zone 11 is wound into a coil at a temperature of 140° C. or lower and within 24 hours from the emergence from the secondary heating zone 11, held at a temperature of 50° to 140° C. for at least 3 hours, that is, subjected to the aforementioned stabilizing treatment. The construction of winding means 6 and holding means 7 is described in conjunction with FIGS. 2, 5, and 6.

In the embodiment of FIG. 2, the winding means 6 is a simple device for taking up the rolled strip into a coil form and the holding means 7 is comprised of a batchwise heating furnace 7A disposed separately from the winding means 6.

Figure 5:
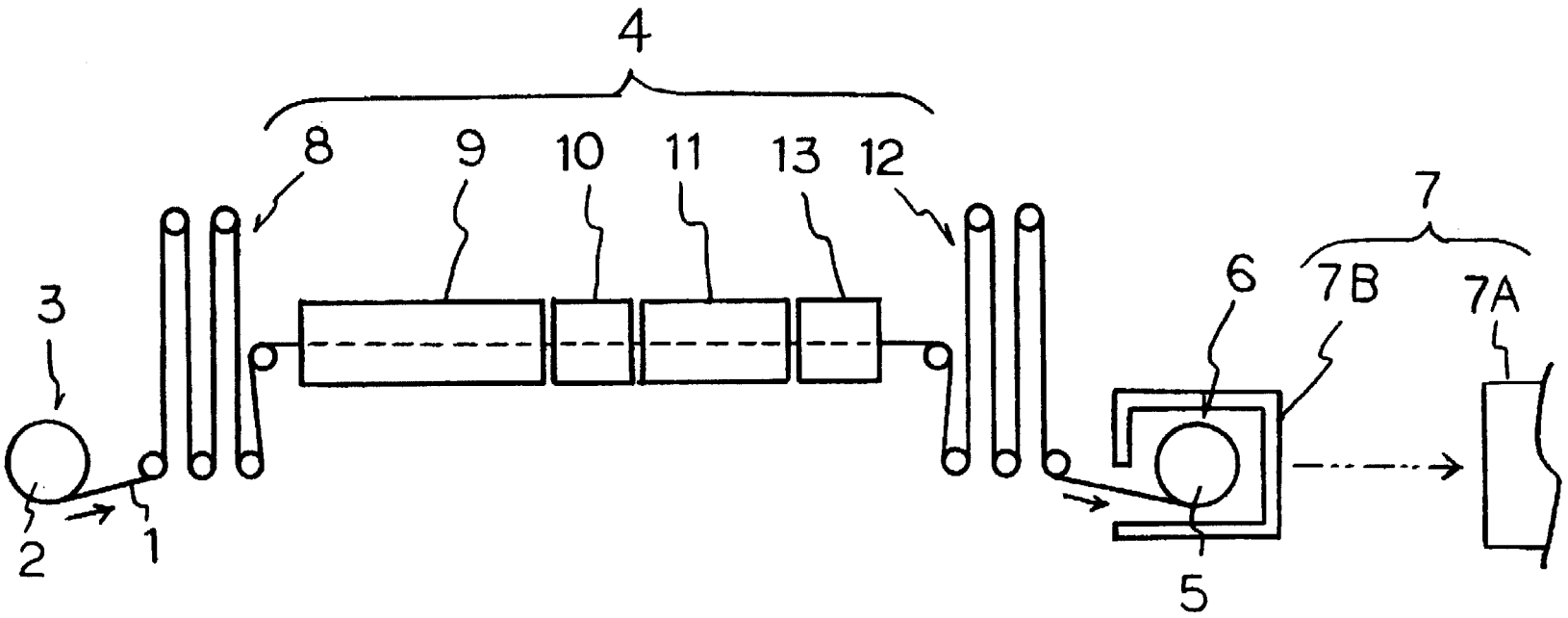

In the embodiment of FIG. 5, the winding means 6 is contained in a thermally insulating furnace 7B so that the rolled strip being wound into a coil 5 may not experience a temperature drop to below 50° C. The coil 5 which has been wound in a temperature keeping condition inside the insulating furnace 7B is transferred to a batchwise heating furnace 7A. In the embodiment of FIG. 5, therefore, the holding means 7 includes the insulating furnace 7B and batchwise heating furnace 7A. Where the coil can be held for 3 hours or more in the insulating furnace 7B, the holding means 7 may consist solely of the insulating furnace 7B. For example, the insulating furnace 7B is movable and after one coil 5 is completely wound therein, the insulating furnace 7B with the coil inside is transferred to another site where the coil is held at the desired temperature inside the furnace.

Figure 6:
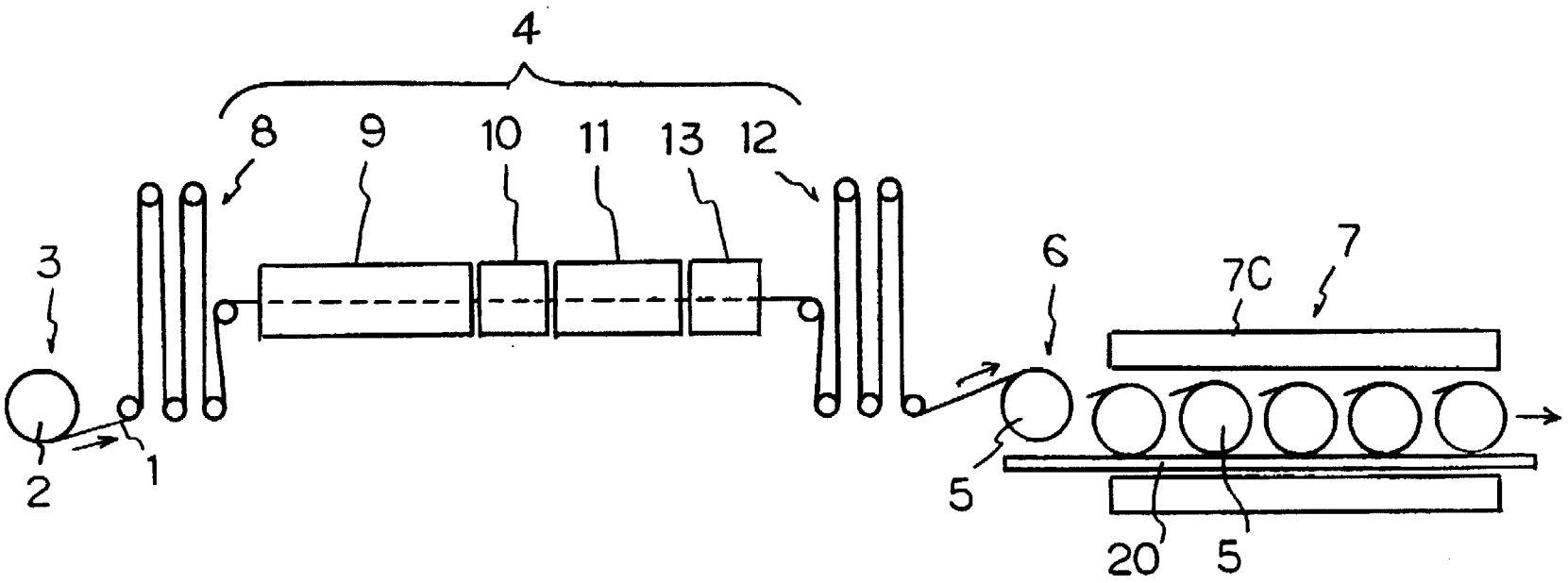

In the embodiment of FIG. 6, the holding means 7 includes a conveyor 20 in the form of a walking beam conveyor, roller conveyor or hanger conveyor for continuously or intermittently conveying forward the coils 5 wound in the winding means 6 and a heater envelope 7C surrounding the conveyor for heating the coils at a temperature of 50° to 140° C. The conveyor 20 and the heater envelope 7C are combined such that the coils may stay there for at least 3 hours at a temperature of 50° to 140° C. In the embodiment of FIG. 6, the winding means 6 is disposed adjacent the conveyor 20 or closely combined with the conveyor 20 whereby the coil 5 can be fed into the heater envelope 7C by the conveyor 20 immediately after it is wound up.

In various embodiments of the strip preparing system as mentioned above, especially in an embodiment using a coil conveying/heating unit (7C, 20) as shown in FIG. 6, the overall process from the initial unraveling of the coil 2 to the final stabilizing treatment can be continuously performed along a line, offering improved efficiency and scale of production.

EXAMPLE

Examples of the present invention are given below by way of illustration and not by way of limitation.

The starting alloys are alloys A, B, and C as shown in Table 1. Rolled strips of 1 mm gage were prepared therefrom by conventional steps of casting by a DC casting technique, soaking at 530° C. for 10 hours, hot rolling, and cold rolling. Thereafter, each rolled strip was heated at 540° C. for 10 seconds as a solution treatment or primary heat treatment and cooled to 45° C. at a cooling rate of 20° C./sec. or to 120° C. at a cooling rate of 50° C./min. (=~8° C./sec.) as shown in Table 2. After 1, 5 or 30 minutes from the end of cooling, secondary heat treatment was carried out at different temperatures for different times as reported in Table 2. The strip was then cooled to different temperatures as reported in Table 2 at a cooling rate of 20° C./sec. At this point, the strip was measured for proof stress or yield strength, which is also reported in Table 2.

After the strip was cooled to a certain temperature at a cooling rate of 20° C./sec., the strip was allowed to stand at that temperature for a varying time and then subjected to stabilizing treatment (or tertiary heat treatment) by holding it at a temperature of 100° C. or 70° C. for a varying time.

The preparation system used herein was the embodiment of FIG. 2 for examples using parameters within the scope of the invention (Run Nos. 3–5, 8, 11, 12, 15, and 16). For comparative examples, the system was somewhat modified according to the selected parameters.

The thus treated strips were measured for proof stress and elongation both within one week and after 3 months from the final treatment (stabilizing treatment =tertiary heat treatment). On the strips as finally treated, paint was coated and baked at 175° C. for 30 minutes. The proof stress after paint baking was measured. The results are shown in Table 3. Table 3 also shows as a secular change the difference (ΔYS) between the proof stress within one week from the final treatment and the proof stress after 3 months. The strips were also subject to various tests to examine whether or not they passed the test. In the column under the "Exam" heading, "X (BH)" indicates that the proof stress was not improved beyond 200N/mm$^2$ by paint baking; "X (formability)" indicates that the proof stress was more than 150 N/mm$^2$ or the elongation was less than 23% in T4 state after preparation; "X (aging)" indicates that the proof stress after 3 months was higher than the proof stress after the final treatment by more than 20 N/mm$^2$; and "O" indicates that the strip passed these tests.

TABLE 1

| | Chemical components (wt %) | | | | | | | | | |
|---|---|---|---|---|---|---|---|---|---|---|
| Alloy | Mg | Si | Fe | Cu | Mn | Cr | Zn | Ti | Zr | Al |
| A | 0.54 | 1.13 | 0.15 | 0.01 | 0.05 | — | — | 0.01 | — | bal. |
| B | 0.85 | 0.92 | 0.18 | — | 0.08 | 0.02 | 0.01 | 0.01 | 0.01 | bal. |
| C | 0.50 | 1.31 | 0.16 | 0.28 | — | 0.12 | 0.25 | 0.01 | 0.03 | bal. |

TABLE 2

| | | Cooling after solution treatment | | Time until secondary heat | Secondary heat treatment | | Cooling after secondary heat treatment | | Time until tertiary | Tertiary heating | | |
|---|---|---|---|---|---|---|---|---|---|---|---|---|
| Run No. | Alloy | Cooling rate (°C./sec.) | Quench temp. (°C.) | treatment (min.) | Temp. (°C.) | Time (sec.) | Temp. (°C.) | Proof stress (N/mm$^2$) | heating (hr.) | Temp. (°C.) | Time (hr.) | Remarks |
| 1 | B | 20 | 45 | 1 | 80 | 0 | >30 | 62 | 5 | 100 | 14 | comparison |
| 2 | B | 20 | 45 | 1 | 80 | 120 | 30 | 76 | 5 | 100 | 12 | comparison |

TABLE 2-continued

| Run No. | Alloy | Cooling after solution treatment: Cooling rate (°C./sec.) | Cooling after solution treatment: Quench temp. (°C.) | Time until secondary heat treatment (min.) | Secondary heat treatment: Temp. (°C.) | Secondary heat treatment: Time (sec.) | Cooling after secondary heat treatment: Temp. (°C.) | Cooling after secondary heat treatment: Proof stress (N/mm²) | Time until tertiary heating (hr.) | Tertiary heating: Temp. (°C.) | Tertiary heating: Time (hr.) | Remarks |
|---|---|---|---|---|---|---|---|---|---|---|---|---|
| 3 | B | 20 | 45 | 1 | 150 | 30 | 100 | 78 | 0 | 100 | 10 | invention |
| 4 | B | 20 | 45 | 1 | 220 | 0 | 100 | 72 | 0 | 100 | 10 | invention |
| 5 | B | 20 | 45 | 1 | 220 | 0 | 30 | 72 | 5 | 100 | 9 | invention |
| 6 | B | 20 | 45 | 1 | 220 | 0 | 30 | 72 | 72 | 100 | 9 | comparison |
| 7 | B | 20 | 45 | 1 | 220 | 0 | 100 | 72 | 3 | 100 | 2 | comparison |
| 8 | B | 20 | 45 | 1 | 180 | 200 | 100 | 94 | 0 | 100 | 7 | invention |
| 9 | B | 20 | 45 | 1 | 220 | 400 | 90 | 125 | 0 | 100 | 2 | comparison |
| 10 | B | 20 | 45 | 1 | 220 | 400 | 80 | 125 | 0 | 100 | 12 | comparison |
| 11 | B | 20 | 45 | 1 | 240 | 0 | 100 | 81 | 0 | 100 | 10 | invention |
| 12 | B | 20 | 45 | 5 | 210 | 0 | 100 | 75 | 0 | 100 | 10 | invention |
| 13 | B | 20 | 45 | 30 | 210 | 0 | 100 | 80 | 0 | 100 | 10 | comparison |
| 14 | B | −0.8 | 120 | 1 | 180 | 10 | 100 | 76 | 0 | 100 | 10 | comparison |
| 15 | A | 20 | 45 | 1 | 220 | 0 | 90 | 78 | 0 | 100 | 12 | invention |
| 16 | C | 20 | 45 | 1 | 220 | 0 | 85 | 87 | 0 | 100 | 10 | invention |

TABLE 3

| Run No. | Alloy | Proof stress within 1 week (N/mm²) | Elongation within 1 week (%) | Proof stress after paint baking (N/mm²) | Proof stress after 3 months (N/mm²) | Elongation after 3 months (%) | ΔYS (N/mm²) | Exam | Remarks |
|---|---|---|---|---|---|---|---|---|---|
| 1 | B | 118 | 28 | 175 | — | — | — | X (BH) | comparison |
| 2 | B | 121 | 29 | 180 | — | — | — | X (BH) | comparison |
| 3 | B | 120 | 29 | 215 | 122 | 29 | 2 | O | invention |
| 4 | B | 117 | 29 | 218 | 119 | 29 | 2 | O | invention |
| 5 | B | 122 | 29 | 209 | 125 | 29 | 3 | O | invention |
| 6 | B | 125 | 28 | 168 | — | — | — | X (BH) | comparison |
| 7 | B | 109 | 29 | 221 | 153 | 24 | 44 | X (aging) | comparison |
| 8 | B | 115 | 29 | 220 | 118 | 29 | 3 | O | invention |
| 9 | B | 131 | 27 | 221 | 163 | 23 | 32 | X (aging) | comparison |
| 10 | B | 163 | 24 | — | — | — | — | x (formability) | comparison |
| 11 | B | 108 | 28 | 209 | 112 | 27 | 4 | O | invention |
| 12 | B | 119 | 29 | 213 | 121 | 29 | 3 | O | invention |
| 13 | B | 121 | 30 | 181 | — | — | — | X (BH) | comparison |
| 14 | B | 116 | 23 | 153 | — | — | — | X (formability) | comparison |
| 15 | A | 111 | 31 | 225 | 113 | 31 | 2 | O | invention |
| 16 | C | 121 | 33 | 231 | 124 | 33 | 3 | O | invention |

As is evident from the results shown in Table 3, the strips treated under conditions within the scope of the invention (Run Nos. 3–5, 8, 11, 12, 15, and 16) have good formability, a full increase of strength by paint baking, and a minimized change with time. In contrast, Run Nos. 1 and 2 failed to achieve a full increase of strength by paint baking since the temperature of secondary heat treatment was too low. Especially in Run No. 1, the proof stress immediately after the secondary heat treatment was too low. Run No. 6 failed to achieve a full increase of strength by paint baking since the lapse of time from the secondary heat treatment to the stabilizing treatment (or tertiary heat treatment) was too long. Run No. 7 experienced a greater change with time due to shortage of the stabilizing treatment time. Run No. 9 had a too high proof stress immediately after the secondary heat treatment and experienced a greater change with time due to shortage of the stabilizing treatment time. Run No. 10 had such a high proof stress immediately after the secondary heat treatment that, when the stabilizing treatment was prolonged until a change with time was negated, the strip was excessively increased in strength and thus lost formability. Run No. 13 failed to achieve a full increase of strength by paint baking since the lapse of time from the solution treatment/quenching to the secondary heat treatment was too long. Run No. 14 failed to secure sufficient formability since the cooling step after the solution treatment used a slow rate and a higher ultimate temperature.

There has been described a system for preparing an aluminum alloy strip by using an alloy of a specific composition, effecting solution treatment at 480° C. or higher, cooling at a proper rate to a temperature in the selected range for ensuring formability, thereafter effecting secondary heat treatment under appropriate conditions for adjusting the strength of the strip to fall in an appropriate range for ensuring potential bake hardenability, thereafter effecting stabilizing treatment under appropriate conditions for inhibiting a change with time at room temperature. The resulting aluminum alloy strip is suitable for mechanical forming and fully meets at the same time the three requirements on automotive body sheets, high strength after paint baking, good formability, and a minimized change with time at room temperature, that is, long-term maintenance of formability. The aluminum alloy strip having these improved functions can be efficiently manufactured on a mass scale. Especially where means for continuously or intermittently transporting the coil of rolled strip forward while heating it at a temperature of 50° to 140° C. for a residence time of at least 3 hours, for example, a coil conveying/heating unit is used, the overall process from the initial unraveling of the coil to the final stabilizing treatment can be continuously performed along a line, offering improved efficiency and scale of production.

Although some preferred embodiments have been described, many modifications and variations may be made thereto in the light of the above teachings. It is therefore to be understood that within the scope of the appended claims, the invention may be practiced otherwise than as specifically described.

We claim:

1. A system for preparing an aluminum alloy strip having improved formability and bake hardenability and a minimized secular change at room temperature, the aluminum alloy consisting essentially of in % by weight, 0.3 to 1.5% of Mg, 0.5 to 2.5% of Si, and the balance of aluminum, said system comprising means for continuously unraveling a rolled strip of the aluminum alloy from its coil, a continuous heat treatment section for continuously receiving the rolled strip from said unraveling means, heat treating it, and delivering it outward, means for continuously winding up the rolled strip exiting from the continuous heat treatment section into a coil form, and means for holding the coil of rolled strip at a temperature in the range of 50° to 140° C. for at least 3 hours, said continuous heat treatment section including a first accumulator for continuously receiving the strip from said unraveling means and feeding it downstream, a primary heating zone disposed downstream of said first accumulator for continuously receiving the strip therefrom and heating it to a temperature of at least 480° C., a first cooling zone disposed downstream of said primary heating zone for continuously receiving the strip therefrom and cooling it at a rate of at least 100° C./min. to a temperature of not greater than 100° C., and a secondary heating zone disposed downstream of said first cooling zone for continuously receiving the strip therefrom and heating it to a temperature in the range of 120° to 250° C. within 10 minutes from the end of cooling.

2. The system of claim 1 wherein said continuous heat treatment section further includes a second cooling zone disposed downstream of said secondary heating zone for continuously receiving the strip therefrom and cooling it to a temperature of not greater than 140° C.

3. The system of claim 2 wherein said continuous heat treatment section further includes a second accumulator disposed downstream of said second cooling zone for continuously receiving the strip therefrom and feeding it to said winding means.

4. The system of claim 1 wherein said continuous heat treatment section further includes a second accumulator disposed between said first cooling zone and said secondary heating zone for continuously transferring the strip therebetween such that the strip may travel through said second accumulator for a residence time within 10 minutes.

5. The system of claim 1 wherein said holding means includes a holding furnace for holding the coil of rolled strip being wound up in said winding means at a temperature in the range of 50° to 140° C.

6. The system of claim 1 wherein said holding means includes means for continuously or intermittently conveying the coil of rolled strip forward while heating it at a temperature in the range of 50° to 140° C. such that the residence time within the temperature range is at least 3 hours.

7. The system of claim 1 wherein the aluminum alloy further contains at least one element selected from the group consisting of 0.03 to 1.2% of Cu, 0.03 to 1.5% of Zn, 0.03 to 0.4% of Mn, 0.03 to 0.4% of Cr, 0.03 to 0.4% of Zr, 0.03 to 0.4% of V, 0.03 to 0.5% of Fe, and 0.005 to 0.2% of Ti.

* * * * *